United States Patent [19]

Wedel

[11] Patent Number: 4,945,655

[45] Date of Patent: Aug. 7, 1990

[54] APPARATUS FOR CUTTING A TAIL FROM A WEB

[75] Inventor: Gregory L. Wedel, Beloit, Wis.

[73] Assignee: Beloit Corporation, Beloit, Wis.

[21] Appl. No.: 230,627

[22] Filed: Aug. 10, 1988

Related U.S. Application Data

[63] Continuation-in-part of Ser. No. 14,569, Feb. 13, 1987, Pat. No. 4,934,067.

[51] Int. Cl.[5] ..... F26B 3/00

[52] U.S. Cl. ..... 34/23; 34/113; 34/117; 162/194; 162/286

[58] Field of Search ..... 34/23, 113, 115, 116, 34/117, 118, 120; 162/193, 194, 368, 286, 255

[56] References Cited

U.S. PATENT DOCUMENTS

| | | | |
|---|---|---|---|
| 1,402,451 | 1/1922 | Shellington . | |
| 3,110,612 | 11/1963 | Gottwald et al. | 34/116 X |
| 4,202,113 | 5/1980 | Kankaanpaa | 34/116 X |
| 4,608,124 | 8/1986 | Mauranen et al. | 162/194 X |

FOREIGN PATENT DOCUMENTS

| | | | |
|---|---|---|---|
| 1572200 | 6/1969 | France . | |
| 2346491 | 10/1977 | France . | |
| 2386638 | 11/1978 | France . | |
| 2173832 | 10/1986 | United Kingdom | 162/368 |
| 8806205 | 8/1988 | World Int. Prop. O. . | |

*Primary Examiner*—Albert J. Makay
*Assistant Examiner*—John Sollecito
*Attorney, Agent, or Firm*—Dirk J. Veneman; Raymond W. Campbell; David J. Archer

[57] ABSTRACT

An apparatus is disclosed for cutting a tail from a web extending from a single tier dryer section to a further single tier dryer section. The apparatus includes a last dryer of the dryer section and a dryer felt extending around the last dryer such that the web is disposed between the dryer felt and the last dryer for drying a second side of the web. A last felt roll is disposed downstream relative to the last dryer such that the felt extends around the last felt roll. A first dryer of the further dryer section is disposed downstream relative to the last dryer and a first felt roll is disposed between the last dryer and the first dryer. A further felt extends around the first felt roll and the first dryer such that the web extends in open draw between the last dryer and the first dryer and thereafter around the first dryer between the further felt and the first dryer for drying a first side of the web. A tail cutter is disposed adjacent to the web for cutting a tail from the web in the open draw.

10 Claims, 4 Drawing Sheets

APPARATUS FOR CUTTING A TAIL FROM A WEB

CROSS-REFERENCE TO RELATED APPLICATION

The present invention is a continuation-in-part of co-pending application Ser. No. 014,569 filed Feb. 13, 1987. All of the subject matter of Ser. No. 014,569, now U.S. Pat. No. 4,934,067 is incorporated herein by reference.

BACKGROUND OF THE INVENTION

1. Field of the Invention

This invention relates to an apparatus and method for cutting a tail from a web. More particularly, this invention relates to a tail cutting apparatus and method for cutting a tail from a web extending between a single tier dryer section to a further single tier dryer section.

2. Information Disclosure Statement

In co-pending patent application Ser. No. 014,569 filed Feb. 13, 1987, a Total BelRun dryer section is disclosed which includes a plurality of alternate top and bottom felted single tier dryer sections which alternately and successively dry alternate sides of the web as the web progresses through the dryer. Total BelRun is a Registered Trademark of Beloit Corporation.

Several advantages are presented by the aforementioned Total BelRun configuration. First, the long open draw between dryers within each dryer section is eliminated. The elimination of such open draw improves the runnability of the web. Second, the vacuum rolls between dryers maintain the sheet shrinkage restraint resulting in more uniform cross-machine directional sheet properties.

However, with the aforementioned Total BelRun configuration, a problem exists in that there is no open draw between the last dryers of the final dryer section and such an open draw is essential for the installation of a tail cutter.

Although the aforementioned problem could be overcome by the provision of a conventional two-felt dryer section in the final dryer section, such two-felted dryer section would greatly reduce the cross-directional sheet shrinkage restraint and this reduced shrinkage restraint would be in a critical portion of the drying cycle.

The present invention overcomes the aforementioned problem by providing an open draw transfer between the last two Total BelRun dryer sections and the installation of a tail cutter adjacent to such open draw transfer.

The advantages provided by the provision of a Total BelRun configuration throughout the dryer is primarily that the drying restraint is extended to the end of the dryer whereas in the conventional two-felt dryer section, the sheet tension between the dryers within a dryer section are to a large extent uncontrolled. Additionally, some web slack may develop in the area where the tail cutter is located.

However, in the configuration according to the present invention, the sheet tension in the open draw is controlled directly by adjusting the relative speeds of the final dryer section with respect to the immediate upstream dryer section.

In a conventional two-felt dryer section, the tail is generally cut just prior to the last one or two dryers. Although the sheet has nearly developed its full strength at this stage, the sheet at this point is also often very dry, particularly in dryer sections which precede a size press. The aforementioned dry sheet can be very abrasive on a cutting knife and the blade life thereof is relatively short. Typically, the knife or blade has to be replaced by a special saw which may result in dusting problems.

However, in the present invention, the web still contains enough moisture to allow a knife to be used as a tail cutter. Such knife not only inhibits the generation of sawdust but also permits the use of a simple tail cutter and minimizes the number of blade changes.

The length of the open draw in which the tail is cut on a conventional machine is often dictated by the specific dryer geometry which is required for runnability, roll and doctor mounting and for ventilation. However, in the present invention, the open draw length can be independently adjusted by adjusting the horizontal and/or vertical space between the dryers adjacent to the transfer draw. Such draw is then set to the minimum required for mounting a tail cutter. The aforementioned arrangement permits the draw length to be as short as possible.

In the present invention, in the event of sheet breakage in the last BelRun dryer section, and if such a break occurs during a tail cutting operation, the tail cutting is unaffected. This is because the sheet is unable to snap back between the dryers and the felt to reach the tail cutter knife when there are more than one or two dryers following the knife.

Therefore, it is a primary object of the present invention to provide an apparatus for cutting a tail from a web extending between a single tier dryer section to a further single tier dryer section.

Other objects and advantages of the present invention will be apparent to those skilled in the art by a consideration of the detailed description contained hereinafter taken in conjunction with the annexed drawings and as defined by the appended claims.

SUMMARY OF THE INVENTION

The present invention relates to an apparatus and method for cutting a tail from a web extending between a single tier dryer section to a further single tier dryer section. The apparatus includes a last dryer of the dryer section and a dryer felt which extends around the last dryer such that the web is disposed between the dryer felt and the last dryer for drying a first side of the web. A last felt roll is disposed downstream relative to the last dryer such that the felt extends around the last felt roll. A first dryer of the further dryer section is disposed downstream relative to the last dryer. A first felt roll is disposed between the last dryer and the first dryer and a further felt extends around the first felt roll and the first dryer such that the web extends in open draw between the last dryer and the first dryer and thereafter around the first dryer between the further felt and the first dryer for drying a second side of the web. A tail cutter is disposed adjacent to the open draw for cutting a tail in the web.

More particularly, the last dryer is bottom felted and the last felt roll is a vacuum roll connected to a source of partial vacuum. The vacuum roll has a variable partial vacuum for removing boundary air from the first dryer and for controlling and stabilizing release of the web from the dryer felt.

Furthermore, the first dryer is top felted and the first felt roll is a vacuum roll connected to a source of partial pressure for generating a variable partial vacuum for removing boundary air from the further felt and for inhibiting air currents in the vicinity of the web in the open draw.

In an alternative embodiment of the present invention, the first felt roll is adjustable from a first position in which the tail cutting means is movable from an inoperative to an operative tail cutting disposition thereof, the first felt roll being movable to a second position for reducing the open draw.

In either of the aforementioned embodiments, the tail cutting means includes alternately a stationary single blade and an adjacent plate disposed parallel to the web in the open draw when in the operative disposition relative to the web or the tail cutting means includes a rotatable circular saw.

In one embodiment of the present invention, the tail cutting means includes air nozzle means secured to the plate for generating a cushion of air between the plate and the web and for stabilizing the web relative to the plate.

The tail cutting means in one embodiment is disposed on the first side of the web and in a further embodiment of the present invention the tail cutting means is disposed on the second side of the web.

Many modifications and variations of the present invention will be apparent to those skilled in the art by consideration of the detailed description contained hereinafter. However, such variations and modifications fall within the spirit and scope of the present invention as defined by the appended claims.

BRIEF DESCRIPTION OF THE DRAWINGS

Similar reference characters refer to similar parts throughout the various embodiments of the present invention.

DETAILED DESCRIPTION OF THE DRAWINGS

Figure 1:
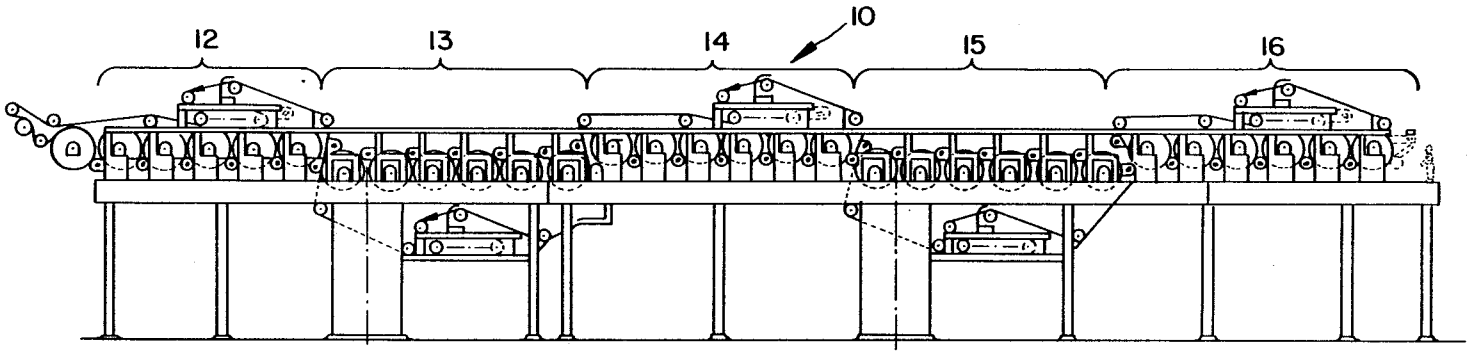
FIG. 1 is a side-elevational view of a Total BelRun dryer section similar to the arrangement disclosed in co-pending patent application Ser. No. 014,569 filed Feb. 13, 1987.

FIG. 1 is a side-elevational view of a Total BelRun dryer section generally designated 10 similar to the type of dryer section disclosed in co-pending patent application Ser. No. 014,569 filed Feb. 13, 1987. The dryer 10 includes dryer sections 12, 13, 14, 15 and 16. Of the dryer sections 12 to 16, dryer sections 12, 14 and 16 are top felted drying sections and dryer sections 13 and 15 are bottom felted.

As shown in FIG. 1, a first side of the web is dried during passage of the web through dryer sections 12, 14 and 16 whereas a second side of the web is dried during movement of the web through dryer sections 13 and 15.

Figure 2:
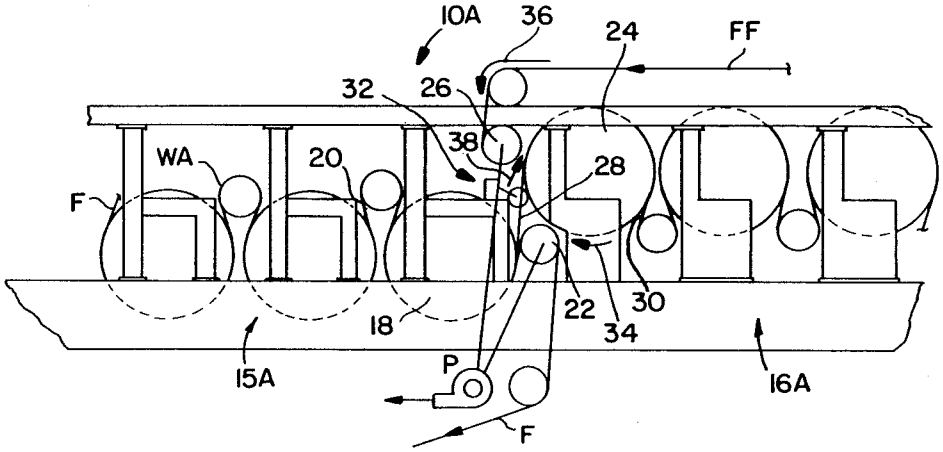
FIG. 2 is an enlarged elevational view of the single tier dryer section and a further final single tier dryer section according to the present invention showing an open draw between the respective dryer sections and a circular saw-type tail cutter disposed in an operative tail cutting disposition adjacent to the open draw.

FIG. 2 is a side-elevational view of an apparatus generally designated 10A according to the present invention for cutting a tail from a web WA extending between a single tier dryer section generally designated 15A to a further single tier dryer section generally designated 16A.

The apparatus 10A includes a last dryer 18 of the dryer section 15A. A dryer felt F extends around the last dryer 18 such that the web WA is disposed between the dryer felt F and the last dryer 18 for drying a second side 20 of the web WA.

A last felt roll 22 is disposed downstream relative to the last dryer 18 such that the dryer felt F extends around the last felt roll 22.

A first dryer 24 of the further dryer section 16A is disposed downstream relative to the last dryer 18. A first felt roll 26 is disposed between the last dryer 18 and the first dryer 24.

A further felt FF extends around the first felt roll 26 and the first dryer 24 such that the web WA extends in open draw 28 between the last dryer 18 and the first dryer 24 and thereafter around the first dryer 24 between the further felt FF and the first dryer 24 for drying a first side 30 of the web WA.

A tail cutting means generally designated 32 is disposed adjacent to the open draw 28 for cutting a tail from the web WA.

More specifically, the last dryer 18 is bottom felted as shown in FIG. 2 and the last felt roll is a vacuum roll and is connected to a source of partial vacuum P for generating a variable partial vacuum within the vacuum roll 22 for removing boundary air as indicated by the arrow 34 from the first dryer 24 and for controlling and stabilizing the release of the web WA from the dryer felt F.

As shown in FIG. 2, the first dryer 24 is top felted and the first felt roll 26 is a vacuum roll which is connected to a source of partial pressure P for generating a variable partial vacuum within the first felt roll 26. Such variable partial vacuum removes boundary air as indicated by the arrow 36 from the further felt FF and assists in inhibiting air currents as indicated by the arrow 38 in the vicinity of the web WA in the open draw 28.

Figure 3:
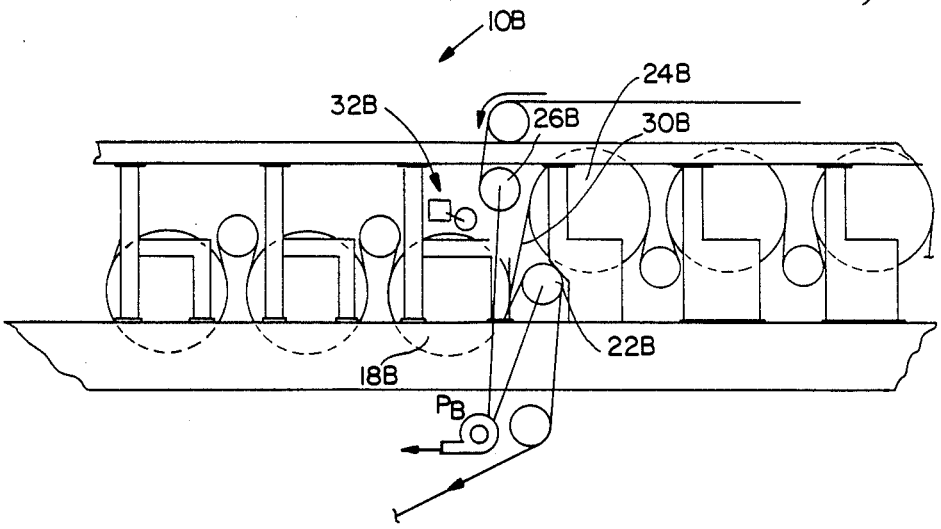
FIG. 3 is a side-elevational view of a further embodiment of the present invention showing the tail cutter including a rotatable cutting saw in an inoperative disposition and a first felt roll in a first position.
Figure 4:
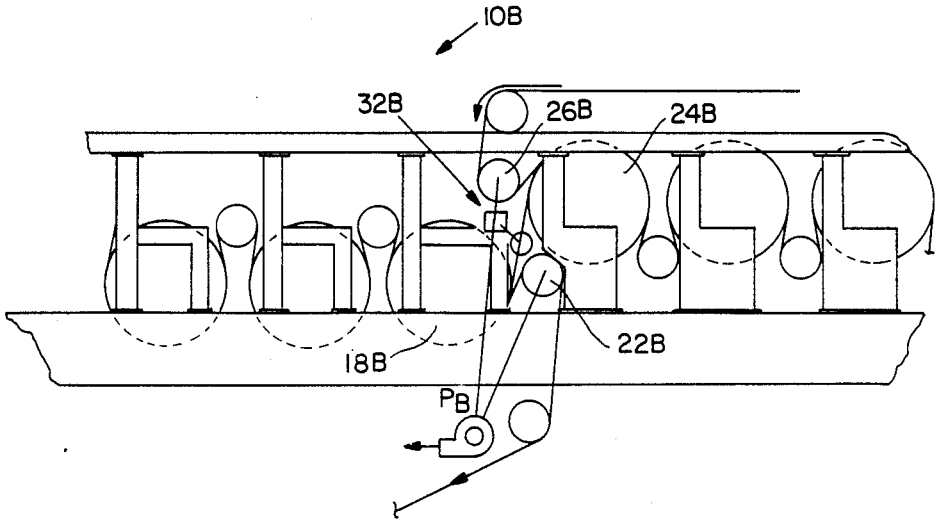
FIG. 4 is a side-elevational view of the embodiment shown in FIG. 3 with the cutter in an operative disposition adjacent to the web.
Figure 5:
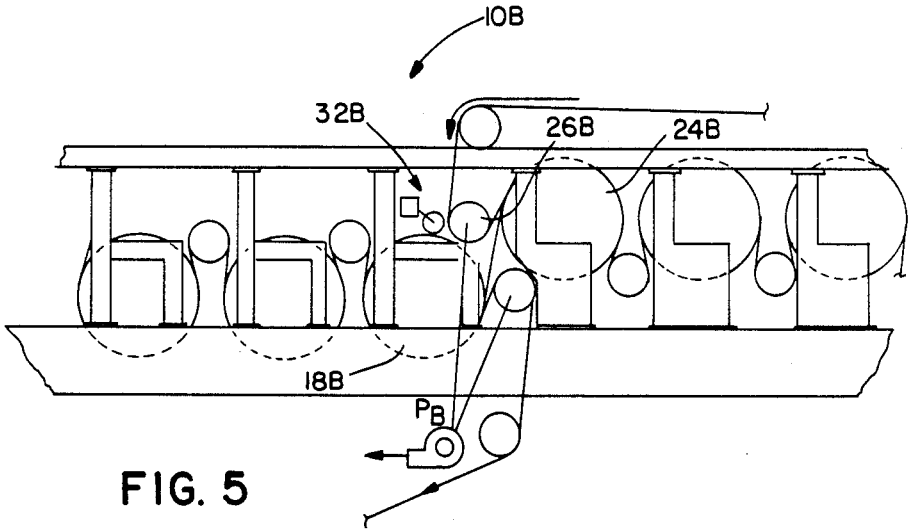
FIG. 5 is a side-elevational view of the embodiment shown in FIG. 3. However, the first felt roll is shown in a second position thereof for reducing the open draw.

FIG. 3 is a side-elevational view of an alternative embodiment of the present invention in which the first felt roll 26B of the apparatus 10B is adjustable from a first position as shown in FIG. 3 in which the tail cutting means 32B is movable from an inoperative disposition as shown in FIG. 3 to an operative disposition thereof shown in FIG. 4. The first felt roll 26B is movable to a second position as shown in FIG. 5 for reducing the open draw 28B when the cutting means 32B is the inoperative disposition.

Figure 6:
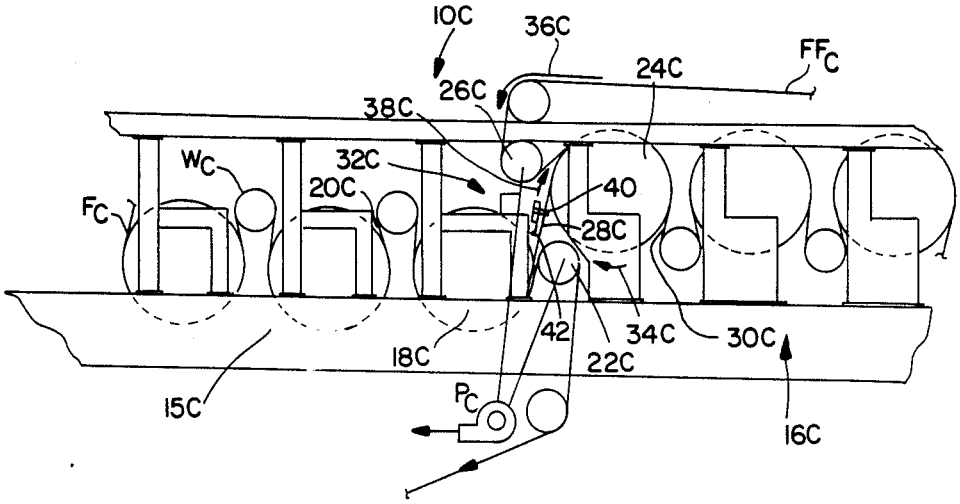
FIG. 6 is a side-elevational view of another embodiment of the present invention in which the circular saw-type tail cutter is replaced by a single blade-type tail cutter.

FIG. 6 shows a further alternative embodiment of the present invention in which an apparatus 10C includes cutting means 32C having a stationary single blade 40 and a plate 42 disposed parallel to the web WC in the open draw 28C when the cutting means 32C is operatively disposed as shown in FIG. 6 relative to the web WC.

Figure 7:
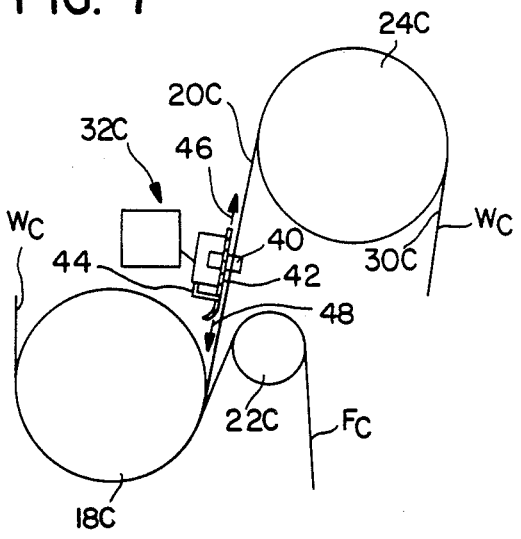
FIG. 7 is an enlarged elevational view of the tail cutting means showing the blade and the plate.

FIG. 7 is an enlarged elevational view of the open draw 28C and shows the tail cutting means 32C having an air nozzle means 44 secured to the plate 42 for generating a cushion of air indicated by the arrows 46 and 48 between the plate 42 and the web WC after stabilizing the web WC relative to the plate 42.

Figure 8:
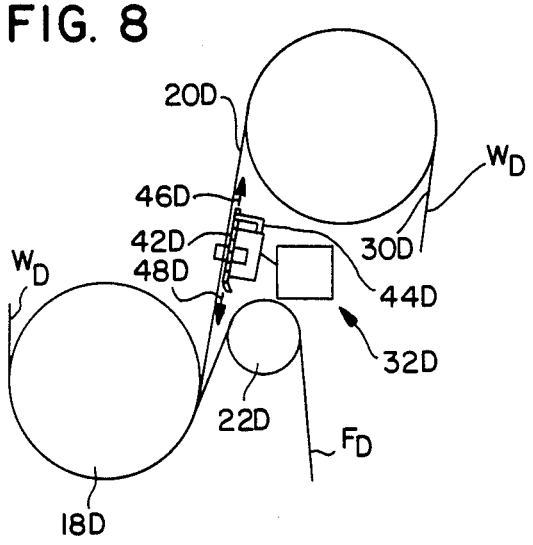
FIG. 8 is an enlarged side-elevational view of the tail cutter with the tail cutter disposed on the opposite side of the web.

In all of the embodiments shown in FIGS. 2 to 7, the tail cutting means is disposed on the second side of the web. However, in an alternative arrangement shown in FIG. 8, the tail cutting means 32D is disposed on the first side 30D of the web WD.

In operation of the apparatus according to the present invention, the tail cutting means is moved from an inoperative position to an operative position adjacent to the open draw of the web for cutting a tail in the web and thereafter moving in a cross-machine direction for widening the tail to the full width of the web. Such tail cutting operation facilitates the threading of the further papermachine.

In the embodiment shown in FIGS. 3–5, when the tail cutting operation has been completed, the first felt roll 26B is moved towards the last dryer 18B for decreasing the open draw thereby increasing web stabilization.

The present invention provides a simple means for the inclusion of a tail cutter in a Total BelRun configuration while maintaining sheet restraint throughout the entire dryer section.

What is claimed is:

1. An apparatus for cutting a tail from a web extending from a single tier dryer section to a further single tier dryer section, said apparatus comprising:

a last dryer of the dryer section;

a dryer felt extending around said last dryer such that the web is disposed between said dryer felt and said last dryer for drying a second side of the web;

a last felt roll disposed downstream relative to said last dryer such that said felt extends around said felt roll;

a first dryer of the further dryer section, said first dryer being disposed downstream relative to said last dryer;

a first felt roll disposed between said last dryer and said first dryer;

a further felt extending around said first felt roll and said first dryer such that the web extends in open draw between said last dryer and said first dryer and thereafter around said first dryer between said further felt and said first dryer for drying a first side of the web;

tail cutter means disposed adjacent to said open draw for cutting the tail for assisting threading of the further dryer section;

said first felt roll being a vacuum roll, said vacuum roll being connected to a source of partial vacuum such that a variable partial vacuum is generated within said first felt roll for removing a boundary layer of air travelling with said further felt, said variable partial vacuum inhibiting air currents disposed in the vicinity of said open draw from disturbing the web disposed in said open draw; and said first felt roll being adjustable such that in a first position thereof, said tail cutting means is movable from an inoperative to an operative tail cutting disposition thereof, said first felt roll being adjustable to a second position thereof for reducing said open draw.

2. An apparatus as set forth in claim 1 wherein said last felt roll is a vacuum roll, said vacuum roll being connected to a source of partial vacuum such that a variable partial vacuum is generated within said last felt roll for removing a boundary layer of air following the surface of said first dryer, said variable partial vacuum also controlling and stabilizing the release of the web from said dryer felt.

3. An apparatus as set forth in claim 1 wherein said first dryer is top felted.

4. An apparatus as set forth in claim 1 wherein said tail cutting means includes:

a stationary single blade;

a plate disposed adjacent to said blade, said plate being disposed parallel to the web in said open draw when said tail cutting means is disposed in an operative disposition relative to the web.

5. An apparatus as set forth in claim 4 wherein said tail cutting means further includes:

air nozzle means secured to said plate for generating a cushion of air between said plate and the web for stabilizing the web relative to said plate.

6. An apparatus as set forth in claim 1 wherein said tail cutting means includes a rotatable circular saw.

7. An apparatus as set forth in claim 1 wherein said tail cutting means is disposed on said first side of the web.

8. An apparatus as set forth in claim 1 wherein said last dryer is bottom felted.

9. An apparatus as set forth in claim 1 wherein said tail cutting means is disposed on said second side of the web.

10. A method for cutting a tail from a web extending from a single tier dryer section to a further single tier dryer section, said method comprising the steps of:

guiding the dryer felt around a last dryer of a dryer section such that the web is disposed between the dryer felt and the last dryer for drying a second side of the web;

guiding the felt around a last felt roll disposed downstream relative to the last dryer;

guiding a further felt around a first felt roll and thereafter around a first dryer of the further dryer section;

guiding the web in open draw between the last dryer and the first dryer and thereafter around the first dryer between the further felt and the first dryer such that a second side of the web is dried as the web extends around the last dryer and a first side of the web is dried when the web extends around the first dryer;

moving a rotating circular saw tail cutter to a position adjacent to the web in the open draw for cutting the tail for assisting threading of the further dryer section; and moving the first felt roll towards the last dryer when the tail cutting step is completed so that the open draw of the web between the dryers is reduced.

* * * * *